US010472963B2

(12) United States Patent
Lin et al.

(10) Patent No.: US 10,472,963 B2
(45) Date of Patent: Nov. 12, 2019

(54) METHOD FOR STEPWISE CONSTRUCTION OF PREFERENTIAL GAS MIGRATION PATHWAY AT STOPE IN COAL SEAM

(71) Applicant: China University of Mining and Technology, Jiangsu (CN)

(72) Inventors: Baiquan Lin, Jiangsu (CN); Tong Liu, Jiangsu (CN); Ting Liu, Jiangsu (CN); Wei Yang, Jiangsu (CN); He Li, Jiangsu (CN); Zhanbo Huang, Jiangsu (CN); Rui Wang, Jiangsu (CN); Yihan Wang, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 0 days.

(21) Appl. No.: 16/097,828

(22) PCT Filed: Dec. 1, 2017

(86) PCT No.: PCT/CN2017/114227

§ 371 (c)(1),
(2) Date: Oct. 30, 2018

(87) PCT Pub. No.: WO2018/171254

PCT Pub. Date: Sep. 27, 2018

(65) Prior Publication Data

US 2019/0145259 A1 May 16, 2019

(30) Foreign Application Priority Data

Mar. 20, 2017 (CN) ..... 2017 1 0165699

(51) Int. Cl.
*E21F 7/00* (2006.01)

(52) U.S. Cl.
CPC ..... *E21F 7/00* (2013.01)

(58) Field of Classification Search
CPC ..... E21F 7/00
See application file for complete search history.

(56) References Cited

U.S. PATENT DOCUMENTS 4,978,172 A * 12/1990 Schwoebel ..... E21B 43/305 166/369
2019/0145260 A1* 5/2019 Lin ..... E21F 7/00

FOREIGN PATENT DOCUMENTS

CN 101082283 12/2007
CN 101251028 8/2008
(Continued)

OTHER PUBLICATIONS

"International Search Report (Form PCT/ISA/210)", dated Feb. 24, 2018, with English translation thereof, pp. 1-4.

*Primary Examiner* — Sunil Singh
(74) *Attorney, Agent, or Firm* — JCIPRNET

(57) ABSTRACT

A method for stepwise construction of a preferential gas migration pathway at a stope in a coal seam. First, a gas migration pathway is preliminarily formed at a stope depending on a mining effect of mining in a first mined seam. construction and stabilization method of gob-side entry retaining in deep strata, and a method of manual-guided pre-fracturing boreholes are then used to perform active construction respectively in external space and the outside of coal-rock mass to form preferential gas migration pathways. Eventually, under the effect of mining-induced stress, a system of preferential gas migration pathways connected to each other at the stope is further formed.

7 Claims, 2 Drawing Sheets

(56) References Cited

FOREIGN PATENT DOCUMENTS

| | | |
|---|---|---|
| CN | 103362540 | 10/2013 |
| CN | 104712358 | 6/2015 |
| CN | 106837408 | 6/2017 |
| RU | 2159333 | 11/2000 |

* cited by examiner

METHOD FOR STEPWISE CONSTRUCTION OF PREFERENTIAL GAS MIGRATION PATHWAY AT STOPE IN COAL SEAM

CROSS-REFERENCE TO RELATED APPLICATION

This is a 371 application of the International PCT application serial no. PCT/CN2017/114227, filed on Dec. 1, 2017, which claims the priority benefits of China Application No. 201710165699.0, filed on Mar. 20, 2017. The entirety of each of the above-mentioned patent applications is hereby incorporated by reference herein and made a part of this specification.

BACKGROUND OF THE INVENTION

Technical Field

The present invention relates to a method for stepwise construction of a preferential gas migration pathway at a stope in a coal seam, which is particularly applicable to step-by-step construction of gas migration pathways inside and outside coal-rock mass at a stope in a first mined seam of deep coal seams.

Background

Coal mining in China has gradually entered the era of deep well mining. After a first mined seam of deep coal seams has been mined, a large amount of mining gas in the seam and pressure relief gas in adjacent coal seams pour into stopping space, and the gas problem becomes increasingly severe. A conventional U-type ventilation manner becomes less applicable, and it is difficult to form a preferential air flow system. Moreover, as the mining depth increases, the geostress in deep coal seams rises, roadways deform severely, and building is difficult during gob-side entry retaining in deep strata. It is difficult to form preferential gas flow pathways in a space external to coal-rock mass. As a result, the discharge and mining efficiency of gas in a space external to coal-rock mass is low, and gas accumulates in local areas. Meanwhile, deep coal seams have complex occurrence conditions. Under hard-roof conditions and deep-stress environments, it is difficult to use a natural mining effect to form roof vertical fracture pathways in coal-rock mass. Gas can hardly migrate upward along roof vertical fracture pathways to concentrate. Gas cannot migrate smoothly inside coal-rock mass. Consequently, a large amount of gas accumulates in goafs, resulting in gas overruns. Therefore, how to implement the construction of preferential gas migration pathways outside and inside coal-rock mass in high-stress and complex-occurrence conditions in deep wells becomes a problem that urgently needs to be resolved in efficient control of gas in a first mined seam of deep coal seams.

SUMMARY OF THE INVENTION

The objective of the present invention is to provide a method for stepwise construction of a preferential gas migration pathway at a stope in a coal seam that is scientific and effective and can effectively resolve problems such as excessive gas emission, low gas flow rate and low gas extraction efficiency that exist in a first mined seam of deep coal seams. Preferential gas migration pathways are respectively constructed and formed in internal space and external space of a stope in a coal seam to form a system of preferential gas migration pathways connected to each other at a stope, thereby implementing preferential migration and efficient concentration of gas at a stope, so as to provide a basis for comprehensive diversion and control of gas at a stope.

To achieve the foregoing objective, a method for stepwise construction of a preferential gas migration pathway at a stope in a coal seam of the present invention includes the following steps.

a. Performing conventional mining of a first mined seam, where a working face, an auxiliary intake airway, and a primary intake airway form a gas migration pathway outside coal-rock mass at a stope, at the same time, due to a mining-induced stress and a mining-induced pressure relief effect, mining-induced fractures in a coal seam develop, in-seam mining-induced fractures are formed in the first mined seam, and roof vertical fractures and floor penetrating fractures are respectively formed in a roof stratum and a floor stratum.

b. After the working face advances as mining takes place, building an entry-retaining wall rapidly in the first mined seam, and rapidly forming a retained-entry preferential gas migration pathway behind the working face, that is, forming an efficient guide pathway for gas in a space external to the coal-rock mass at the stope, so that a flowing direction of wind is optimized, gas in the space external to the coal-rock mass flows with an air flow along the guide pathway, the gas in the space external to the coal-rock mass is effectively guided and discharged, and accumulation of gas in local areas in the space external to the coal-rock mass is avoided.

c. Determining a range of a critical reinforced supporting and stabilizing area the retained-entry preferential gas migration pathway according to variation and distribution characteristics of mining-induced stress, and performing sectional reinforced supporting and stabilization on the auxiliary intake airway and the retained-entry preferential gas migration pathway in a mining-induced stress influence area.

d. During mining of the first mined seam, for a change condition of a roof, when a hard roof condition occurs, constructing manual-guided pre-fracturing boreholes into a hard roof in advance of the working face in the auxiliary intake airway and the primary intake airway, where generated manual-guided fractures induce the formation of a roof-vertical-fracture preferential gas migration pathway in a coal-rock stratum at the stope as mining-induced stress changes and promotes the formation of an overlying stratum rock fracture area, and an in-seam mining-induced fracture area and a goaf loose rock fracture area are connected to the overlying stratum rock fracture area through the roof-vertical-fracture preferential gas migration pathway, so as to avoid accumulation of gas in a goaf and promote flowing and concentration of gas of the stope.

e. After the roof-vertical-fracture preferential gas migration pathway internal to the coal-rock mass and the retained-entry preferential gas migration pathway external to the coal-rock mass have been gradually constructed at the stope, continuing with the advance of the working face, where a large amount of gas in the in-seam mining-induced fracture area of the first mined seam is desorbed, diffused, and flows into the working face, the auxiliary intake airway, and the primary intake airway and further flows into the retained-entry preferential gas migration pathway and the goaf along the guide pathway, and a part of gas in the space external to the coal-rock mass in the working face, the auxiliary intake airway, and the primary intake airway and the in-seam mining-induced fracture area migrates upward along the roof-vertical-fracture preferential gas migration pathway and concentrates in the overlying stratum rock fracture area.

As the working face advances, due to mining in the first mined seam, the floor penetrating fractures gradually develop into a floor-penetrating-fracture preferential gas migration pathway under a mining-induced pressure relief effect, pressure relief gas in an underlying coal seam migrates upward along the floor-penetrating-fracture preferential gas migration pathway and flows into the working face, the auxiliary intake airway, the primary intake airway, the retained-entry preferential gas migration pathway, and the goaf in the first mined seam, gas concentrates in the goaf loose rock fracture area, and at the same time gas in the goaf migrates upward along the roof-vertical-fracture preferential gas migration pathway and concentrates in the overlying stratum rock fracture area.

f. With further mining in the first mined seam, repeating steps a to e to enable gas to flow in an efficient and orderly manner along the constructed retained-entry preferential gas migration pathway in the space external to the coal-rock mass, where at the same time gas flows and concentrates along the constructed roof-vertical-fracture preferential gas migration pathway and floor-penetrating-fracture preferential gas migration pathway in the coal-rock stratum, under the effect of mining-induced stress, a system of preferential gas migration pathways connected to each other at the stope is eventually formed, and gas concentration areas in the in-seam mining-induced fracture area, the goaf loose rock fracture area, the overlying stratum rock fracture area, and an underlying coal-rock stratum rock and coal-seam fracture area are gradually forming, so as to create desirable conditions for centralized diversion and extraction of gas.

The critical reinforced supporting and stabilizing area is in a range from a distance a in advance of the working face to a distance b behind from the working face, and both the distance a and the distance b are no less than 200 m.

The entry-retaining wall is built of a high-performance filling material to adapt to a high geostress environment characteristic in the deep first mined seam and achieve better goaf isolation, thereby implementing stable and efficient guidance of gas by the retained-entry preferential gas migration pathway.

A manner of the performing sectional reinforced supporting and stabilization on the auxiliary intake airway and the retained-entry preferential gas migration pathway in a mining-induced stress influence area is: combining deep-anchor supporting, a single prop, and "U-shaped steel+borehole jet grouting" to perform reinforced supporting to ensure that no large deformation occurs in the auxiliary intake airway and the retained-entry preferential gas migration pathway, and flexibly increasing and decreasing the density and strength of supporting according to a variation characteristic of mining-induced stress to keep the stability of the auxiliary intake airway and the retained-entry preferential gas migration pathway, thereby further implementing stable and efficient guidance of gas in the space external to the coal-rock mass by the retained-entry preferential gas migration pathway.

Construction angles, orientations, a quantity, and a group interval of the manual-guided pre-fracturing boreholes should be optimized and determined according to a hardness and a thickness of the hard roof.

The manual-guided pre-fracturing boreholes are the manual-guided fractures formed inside the hard roof in advance by means of an artificial pre-fracturing technique comprising blasting or hydrofracturing.

Beneficial effect: Gas diffuses and migrates randomly after a coal seam is mined. Therefore, in the present invention, a fracture pathway is constructed inside coal mass and a retained pathway is constructed outside the coal mass to form a preferential gas flow pathway to facilitate efficient flowing and concentration of gas in a preferential direction to facilitate discharge and centralized extraction. A mining-induced effect in a first mined seam is cleverly used to combine a mining effect and an active manual measure to implement step-by-step construction of preferential gas flow pathways inside and outside a stope in a first mined seam of deep coal seams. In this way, problems such as large deformations in gas discharge and mining pathways in a space external to coal-rock mass at the stope in the first mined seam, low discharge and mining efficiency, difficulty in diversion and control, difficulty in forming a fracture pathway in the roof of coal-rock mass, unsmooth gas flowing, and difficulty in achieving preferential migration and efficient concentration are resolved. These problems are caused by high geostress in deep coal seams, a severe mining-induced stress environment, and a complex roof environment in a coal seam. After a system of gas flow pathways is preliminarily formed by using a mining effect in a stope area, manual technical methods are implemented at critical local locations that affect gas migration at a stope in a deep coal seam to actively construct or induce the formation of a preferential gas migration pathway. Eventually, with the further promotion of the mining-induced effect, a system of preferential gas migration pathways connected to each other at the stope is formed in the stope area. The present invention implements stepwise construction of "area-local-area" gas migration pathways at a stope in a first mined seam of deep coal seams and creates preferential migration, flowing, and concentrate conditions for gas of the stope in the first mined seam, thereby resolving the problem of difficulty in forming a gas migration pathway at a stope in a deep coal seam and difficulty in efficient flowing and concentration of gas. Therefore, preferential migration and efficient concentration of gas at a stope are facilitated, and at the same time the basis is provided for centralized diversion and control of gas at a stope. The present invention has high value of in-situ application and promotion.

Figure 1:
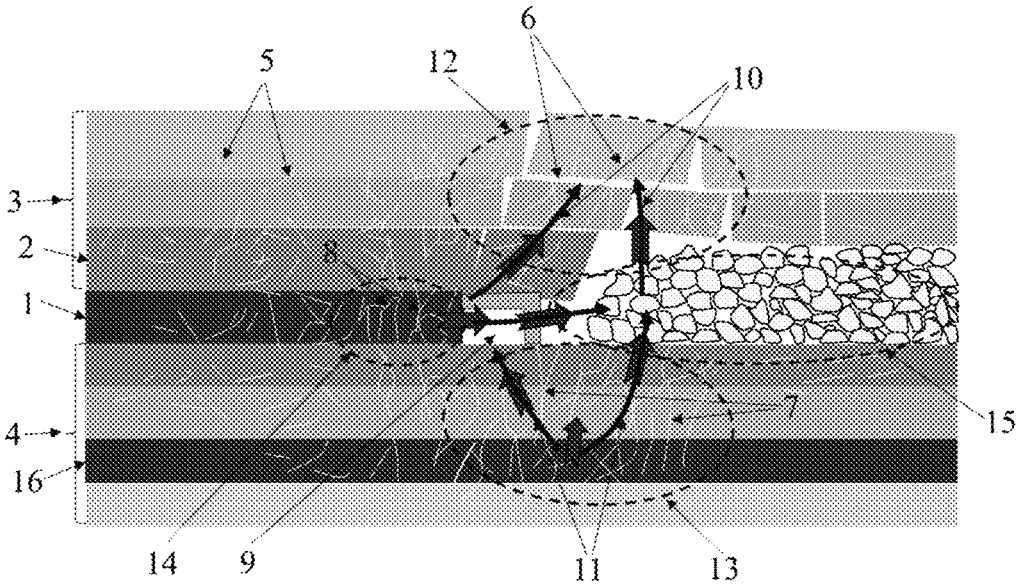
FIG. 1 is a schematic view of overall construction of a preferential gas migration pathway at a stope in a coal seam according to the present invention.

In the drawings: 1—first mined seam, 2—roof (hard roof), 3—roof stratum, 4—floor stratum, 5—mining-induced fracture, 6—roof vertical fracture, 7—floor penetrating fracture, 8—in-seam mining-induced fracture, 9—working face, 10—roof-vertical-fracture preferential gas migration pathway, 11—floor-penetrating-fracture preferential gas migration pathway, 12—overlying stratum rock fracture area, 13—underlying coal-rock stratum rock and coal-seam fracture area, 14—in-seam mining-induced fracture area, 15—goaf loose rock fracture area, 16—underlying coal seam, 17—auxiliary intake airway, 18—primary intake airway, 19—retained-entry preferential gas migration pathway,

20—entry-retaining wall, 21—critical reinforced supporting and stabilizing area, 22—air flow, 23—manual-guided fracture, 24—manual-guided pre-fracturing borehole, and 25—goaf.

DETAILED DESCRIPTION OF THE INVENTION

The present invention is further described below with reference to the embodiments in the accompanying drawings.

Figure 2:
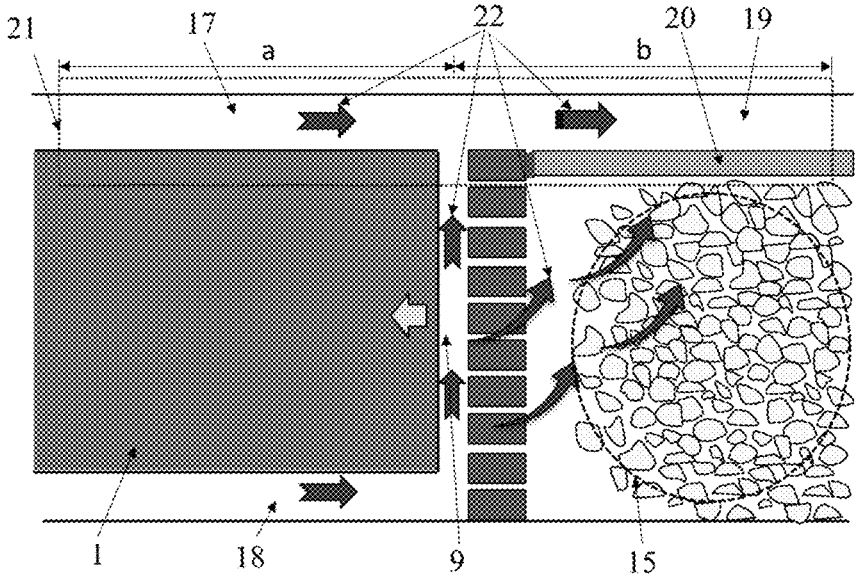
FIG. 2 is a schematic view of construction of a retained-entry preferential gas migration pathway according to the present invention.
Figure 3:
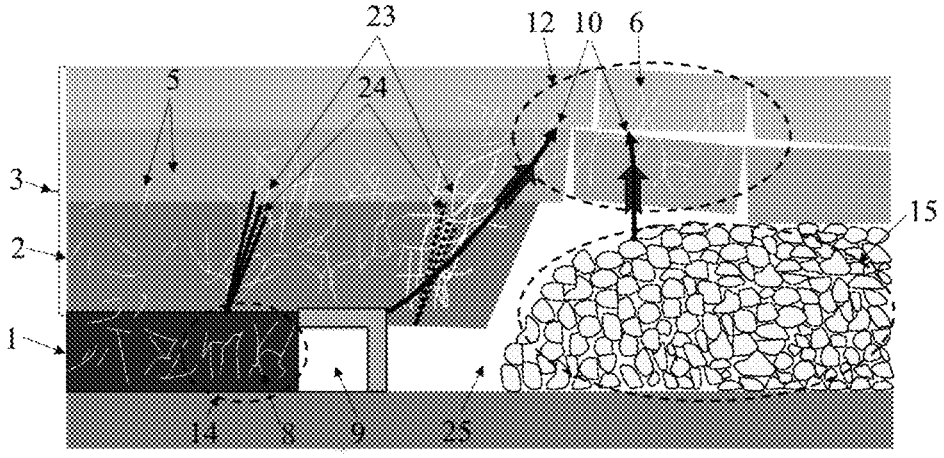
FIG. 3 is a schematic view of construction of a preferential gas flow pathway in a roof stratum by using manual-guided pre-fracturing boreholes according to the present invention.

Specific steps of a method for stepwise construction of a preferential gas migration pathway at a stope in a coal seam of the present invention are as follows.

a. As shown in FIG. 1 and FIG. 2, performing conventional mining of a first mined seam 1, where a working face 9, an auxiliary intake airway 17, and a primary intake airway 18 form a gas migration pathway outside coal-rock mass at a stope, due to a mining-induced stress and a mining-induced pressure relief effect, mining-induced fractures 5 in a coal seam develop, in-seam mining-induced fractures 8 are formed in the first mined seam 1, and roof vertical fractures 6 and floor penetrating fractures 7 are respectively formed in a roof stratum 3 and a floor stratum 4.

b. After the working face 9 advances as mining takes place, building an entry-retaining wall 20 rapidly in the first mined seam 1, forming a Y-type ventilation system, and rapidly forming a retained-entry preferential gas migration pathway 19 behind the working face 9, that is, forming an efficient guide pathway for gas in a space external to the coal-rock mass at the stope, so that a flowing direction of wind is optimized, as shown in FIG. 2, gas in the space external to the coal-rock mass flows with an air flow 22 along the guide pathway, the gas in the space external to the coal-rock mass is effectively guided and discharged, and accumulation of gas in local areas in the space external to the coal-rock mass is avoided; the entry-retaining wall 20 is made of a high-performance filling material to adapt to a high geostress environment characteristic in the deep first mined seam 1 and achieve a better goaf isolation, thereby implementing stable and efficient guidance of gas by the retained-entry preferential gas migration pathway 19; the high-performance filling material has characteristics of high early strength, high bonding property, and high strength, and is formed of cement, pebbles, fly ash, and a specific additive in particular proportions; the mixing amount of the additive is 0.5% to 1.2% of the weight of cement, and the material has high early strength; the eventual consolidation strength may reach 30 MPa, thereby achieving relatively high adaptability to a high geostress environment characteristic in the first mined seam 1; and the particle sizes of the pebbles need to be less than 20 mm to improve the material granularity, thereby ensuring relatively high tightness.

c. Determining a range of a critical reinforced supporting and stabilizing area 21 of the retained-entry preferential gas migration pathway 19 according to variation and distribution characteristics of mining-induced stress, and performing sectional reinforced supporting and stabilization on the auxiliary intake airway 17 and the retained-entry preferential gas migration pathway 19 in a mining-induced stress influence area, where the range of the critical reinforced supporting and stabilizing area 21 of the retained-entry preferential gas migration pathway 19 is determined according to variation and distribution characteristics of mining-induced stress, the range of the critical reinforced supporting and stabilizing area 21 is determined according to a stress distribution characteristic of the retained-entry preferential gas migration pathway, generally the distance in advance of the working face 9 is a, and the distance in rear of the working face 9 is b; the critical reinforced supporting and stabilizing area 21 is in a range from a distance a in advance of the working face 9 to a distance b behind from the working face 9; both the distance a and the distance b are no less than 200 m; and a manner of the performing sectional reinforced supporting and stabilization on the auxiliary intake airway 17 and the retained-entry preferential gas migration pathway 19 in a mining-induced stress influence area is: combining deep-anchor supporting, a single prop, and "U-shaped steel+borehole jet grouting" to perform reinforced supporting to ensure that no large deformation occurs in the auxiliary intake airway 17 and the retained-entry preferential gas migration pathway 19, and flexibly increasing and decreasing the density and strength of supporting according to a variation characteristic of mining-induced stress to keep the stability of the auxiliary intake airway 17 and the retained-entry preferential gas migration pathway 19, thereby further implementing stable and efficient guidance of gas in the space external to the coal-rock mass by the retained-entry preferential gas migration pathway 19.

d. During mining of the first mined seam 1, for a change condition of a roof 2, as shown in FIG. 3, when a hard roof condition occurs, constructing manual-guided pre-fracturing boreholes 24 into a hard roof 2 in advance of the working face 9 in the auxiliary intake airway 17 and the primary intake airway 18, where the height of a group of manual-guided pre-fracturing boreholes 24 needs to exceed the thickness of the hard roof, and construction angles, orientations, a quantity, and a group interval of the manual-guided pre-fracturing boreholes 24 should be optimally set according to the hardness and thickness of the hard roof 2; the manual-guided pre-fracturing boreholes 24 are manual-guided fractures 23 formed inside the hard roof 2 in advance by means of an artificial pre-fracturing technique comprising blasting or hydrofracturing; the generated manual-guided fractures 23 induce the formation of a roof-vertical-fracture preferential gas migration pathway 10 in a coal-rock stratum at the stope as mining-induced stress changes and promotes the formation of an overlying stratum rock fracture area 12, and an in-seam mining-induced fracture area 14 and a goaf loose rock fracture area 15 are connected to the overlying stratum rock fracture area 12 through the roof-vertical-fracture preferential gas migration pathway 10, so as to avoid accumulation of gas in a goaf 25 and promote flowing and concentration of gas of the stope; the hard roof condition is determined according to *Roof Classification Scheme for Stopping Working Faces in Gently Inclined and Inclined Coal Seams* released in China; the basic concepts of a false roof, an immediate roof, and a main roof are clarified in the scheme first; immediate roofs are classified into four types according to stability; main roofs are classified into four types according to weighting strength; eventually, two categories are combined respectively, and stope roofs are classified into 11 types; and hard roofs are III1, III2, III3, III4, IV4.

e. After the roof-vertical-fracture preferential gas migration pathway internal to the coal-rock mass and the retained-entry preferential gas migration pathway external to the coal-rock mass have been gradually constructed at the stope, as shown in FIG. 3, continuing with the advance of the working face 9, where a large amount of gas in the in-seam mining-induced fracture area 14 of the first mined seam 1 is desorbed, diffused, and flows into the working face 9, the auxiliary intake airway 17, and the primary intake airway 18 and further flows into the retained-entry preferential gas migration pathway 19 and the goaf 25 along the guide pathway, and a part of gas in the space external to the coal-rock mass at the working face 9, the auxiliary intake airway 17, and the primary intake airway 18 and the in-seam mining-induced fracture area 14 migrates upward along the roof-vertical-fracture preferential gas migration pathway 10 and concentrates in the overlying stratum rock fracture area 12.

As the working face 9 advances, due to mining in the first mined seam 1, the floor penetrating fractures 7 gradually develop into a floor-penetrating-fracture preferential gas migration pathway 11 under a mining-induced pressure relief effect, pressure relief gas in an underlying coal seam 16 migrates upward along the floor-penetrating-fracture preferential gas migration pathway 11 and flows into the working face 9, the auxiliary intake airway 17, the primary intake airway 18, the retained-entry preferential gas migration pathway 19, and the goaf 25 in the first mined seam, gas concentrates in the goaf loose rock fracture area 15, and at the same time gas in the goaf 25 migrates upward along the roof-vertical-fracture preferential gas migration pathway 10, and concentrates in the overlying stratum rock fracture area 12.

f. With further mining in the first mined seam 1, continuously repeating steps a to e to enable gas to flow along the constructed retained-entry preferential gas migration pathway 19 in the space external to the coal-rock mass, so that efficient guide is implemented, where at the same time gas flows and concentrates along the constructed roof-vertical-fracture preferential gas migration pathway 10 and floor-penetrating-fracture preferential gas migration pathway 11 in the coal-rock stratum, under the effect of mining-induced stress, a system of preferential gas migration pathways connected to each other at the stope is eventually formed, and gas concentration areas in the in-seam mining-induced fracture area 14, the goaf loose rock fracture area 15, the overlying stratum rock fracture area 12, and an underlying coal-rock stratum rock and coal-seam fracture area 13 are gradually formed, so as to create desirable conditions for centralized diversion and extraction of gas; and scientific and effective stepwise construction of preferential migration pathways for gas at a stope is implemented, and preferential migration and efficient concentration of gas of the stope are promoted.

What is claimed is:

1. A method for stepwise construction of a system of gas migration pathways at a stope in a coal seam, comprising:

a. performing a conventional mining of a first mined seam, wherein a working face, an auxiliary intake airway, and a primary intake airway form a gas migration pathway outside a coal-rock mass at the stope, at the same time, due to a mining-induced stress and a mining-induced pressure relief effect, mining-induced fractures in the coal seam develop, in-seam mining-induced fractures are formed in the first mined seam, and roof vertical fractures and floor penetrating fractures are respectively formed in a roof stratum and a floor stratum;

b. after the working face advances as mining takes place, building an entry-retaining wall rapidly in the first mined seam, thereby rapidly forming a retained-entry preferential gas migration pathway, which is part of the system of the gas migration pathways, behind the working face, that is, forming an efficient guide pathway for gas in a space external to the coal-rock mass at the stope, so that a flowing direction of wind is optimized, gas in the space external to the coal-rock mass flows with an air flow along the guide pathway, the gas in the space external to the coal-rock mass is effectively guided and discharged, and accumulation of gas in local areas in the space external to the coal-rock mass is avoided;

c. determining a range of a critical reinforced supporting and stabilizing area of the retained-entry preferential gas migration pathway and the auxiliary intake airway according to the mining-induced stress, and performing sectional reinforced supporting and stabilization on the auxiliary intake airway and the retained-entry preferential gas migration pathway in a mining-induced stress influence area;

d. during mining of the first mined seam, for a change condition of a roof, when a hard roof condition occurs, constructing manual-guided pre-fracturing boreholes into a hard roof in advance of the working face in the auxiliary intake airway and the primary intake airway, wherein generated manual-guided fractures induce a formation of a roof-vertical-fracture preferential gas migration pathway in a coal-rock stratum at the stope as the mining-induced stress changes, and promote a formation of an overlying stratum rock fracture area, and an in-seam mining-induced fracture area and a goaf loose rock fracture area are connected to the overlying stratum rock fracture area through the roof-vertical-fracture preferential gas migration pathway, so as to avoid accumulation of gas in a goaf and promote flowing and concentration of gas of the stope;

e. after the roof-vertical-fracture preferential gas migration pathway internal to the coal-rock mass and the retained-entry preferential gas migration pathway external to the coal-rock mass have been gradually constructed at the stope, continuing with the advance of the working face, wherein a large amount of gas in the in-seam mining-induced fracture area of the first mined seam is desorbed, diffused, and flows into the working face, the auxiliary intake airway, and the primary intake airway and further flows into the retained-entry preferential gas migration pathway and the goaf along the guide pathway, and a part of gas in the space external to the coal-rock mass in the working face, the auxiliary intake airway, and the primary intake airway and the in-seam mining-induced fracture area migrates upward along the roof-vertical-fracture preferential gas migration pathway and concentrates in the overlying stratum rock fracture area;

as the working face advances, due to mining in the first mined seam, the floor penetrating fractures gradually develop into a floor-penetrating-fracture preferential gas migration pathway under the mining-induced pressure relief effect, pressure relief gas in an underlying coal seam migrates upward along the floor-penetrating-fracture preferential gas migration pathway and flows into the working face, the auxiliary intake airway, the primary intake airway, the retained-entry preferential gas migration pathway, and the goaf in the first mined seam, gas concentrates in the goaf loose rock fracture area, and at the same time gas in the goaf migrates upward along the roof-vertical-fracture preferential gas migration pathway and concentrates in the overlying stratum rock fracture area; and f. with further mining in the first mined seam, repeating steps a to e to enable gas to flow in an efficient and orderly manner along the constructed retained-entry preferential gas migration pathway in the space external to the coal-rock mass, where at the same time gas flows and concentrates along the constructed roof-vertical-fracture preferential gas migration pathway and the floor-penetrating-fracture preferential gas migration pathway in the coal-rock stratum, under the effect of mining-induced stress, the system of the gas migration pathways connected to each other at the stope is eventually formed, and gas concentration areas in the in-seam mining-induced fracture area, the goaf loose rock fracture area, the overlying stratum rock fracture area, and an underlying coal-rock stratum rock and coal-seam fracture area are gradually formed, so as to create desirable conditions for centralized diversion and extraction of gas.

2. The method for stepwise construction of a system of gas migration pathways at a stope in a coal seam according to claim 1, wherein the critical reinforced supporting and stabilizing area is in a range from a distance a in advance of the working face to a distance b behind from the working face, and both the distance a and the distance b are no less than 200 m.

3. The method for stepwise construction of a system of gas migration pathways at a stope in a coal seam according to claim 1, wherein the entry-retaining wall is built of a high-performance filling material to adapt to a high geo-stress environment characteristic in the deep first mined seam and achieve a better goaf isolation, thereby implementing stable and efficient guidance of gas by the retained-entry preferential gas migration pathway.

4. The method for stepwise construction of a system of gas migration pathways at a stope in a coal seam according to claim 1, wherein the performing sectional reinforced supporting and stabilization on the auxiliary intake airway and the retained-entry preferential gas migration pathway in a mining-induced stress influence area comprising: combining deep-anchor supporting, a single prop, and "U-shaped steel+borehole jet grouting" to perform reinforced supporting to ensure that no large deformation occurs in the auxiliary intake airway and the retained-entry preferential gas migration pathway, and determining the density and strength of supporting according to the mining-induced stress to keep the stability of the auxiliary intake airway and the retained-entry preferential gas migration pathway, thereby further implementing stable and efficient guidance of gas in the space external to the coal-rock mass by the retained-entry preferential gas migration pathway.

5. The method for stepwise construction of a system of gas migration pathways at a stope in a coal seam according to claim 1, further comprising optimizing and determining construction angles, orientations, a quantity, and a group interval of the manual-guided pre-fracturing boreholes according to a hardness and a thickness of the hard roof.

6. The method for stepwise construction of a system of gas migration pathways at a stope in a coal seam according to claim 5, wherein the manual-guided pre-fracturing boreholes are constructed by forming the manual-guided fractures inside the hard roof in advance by means of an artificial pre-fracturing technique comprising blasting or hydrofracturing.

7. The method for stepwise construction of a system of gas migration pathways at a stope in a coal seam according to claim 1, wherein the manual-guided pre-fracturing boreholes are constructed by forming the manual-guided fractures inside the hard roof in advance by means of an artificial pre-fracturing technique comprising blasting or hydro fracturing.

* * * * *